United States Patent [19]

Tash

[11] Patent Number: 4,475,255

[45] Date of Patent: Oct. 9, 1984

[54] PIPE FLUSHING DEVICE

[76] Inventor: George Tash, 18658 Chase St., Northridge, Calif. 91324

[21] Appl. No.: 514,290

[22] Filed: Jul. 15, 1983

[51] Int. Cl.[3] ..... B08B 9/02

[52] U.S. Cl. ..... 4/256; 134/167 C

[58] Field of Search ..... 4/255–257; 138/93; 134/166 C, 167 C, 168 C, 169 C

[56] References Cited

U.S. PATENT DOCUMENTS

| | | | |
|---|---|---|---|
| 2,755,810 | 7/1956 | Kurt | 4/256 X |
| 3,595,255 | 7/1971 | Mulinex | 4/256 X |
| 3,714,951 | 2/1973 | Lundman | 4/256 X |
| 3,792,708 | 2/1974 | Tash | 134/167 C |
| 3,802,449 | 4/1974 | Mulinex | 4/256 X |
| 3,840,033 | 10/1974 | Warsinger | 4/256 X |

*Primary Examiner*—Charles E. Phillips

*Attorney, Agent, or Firm*—John J. Posta, Jr.

[57] ABSTRACT

The improved pipe flushing device comprises an elongated, elastomeric, hollow tubular member having a middle portion free to expand radially under water pressure. The rear inlet end of the tubular member is fitted with a hose connector, while the narrow front outlet end of the tubular member contains a valve which opens upon expansion of the middle portion. The valve has a cage bearing a rear plate closure, and open sides and front. The rear plate is received in a transverse groove in the outlet, which groove is of a greater length than the thickness of the plate. The cage is gripped and held in a fixed position while the tubular member is in the relaxed unexpanded state. However, when the device is inflated by water pressure from a water hose connected to the inlet connector while in a water pipe, the middle portion thereof expands to meet the wall of the pipe. When the expansion is complete, the cage moves back in the outlet, the plate moving rearwardly in the groove to cause a mechanical vibration in the tubular member and water pipe. Water then by-passes the plate and passes through and out of the cage as a jet to break up a sewage clog. Upon expulsion of the jet, the middle portion contracts and the valve moves forward and closes, again causing sonic vibrations in the tubular member and water pipe. The expansion and contraction of the tubular member rapidly alternate to rapidly pulse water jets and vibrate the pipe to unclog the pipe.

11 Claims, 7 Drawing Figures

PIPE FLUSHING DEVICE

BACKGROUND OF THE INVENTION

1. Field of the Invention

The present invention generally relates to flushing devices and more particularly to an improved device for unclogging water pipes and the like.

2. Prior Art

Many devices have been used to unclog water pipes. These include the so-called "kitchen helper," a suction cup on the end of a handle. This device works to some extent, but frequently creates such a suction that is hard to operate and can loosen pipe joints and cause pipe damage. The so-called Roto-Rooter type of device, which is a reel of spiraled cable which can be fed through a pipe to clear it of obstacles is expensive, requires expert use and also can damage pipes. Many other devices have been used for such purposes, including those shown in U.S. Pat. Nos. 1,893,979, 1,848,269, 3,086,540, and 3,595,255. However, most such devices are not only expensive, but also are complicated to make and use and many damage the water pipes. Most employ corrodable springs (see U.S. Pat. Nos. 1,848,269, 3,086,540 and 1,893,979, for example, and/or chains and complicated valves (see U.S. Pat. No. 3,595,255 for example.

A more successful, less expensive flushing device is set forth in U.S. Pat. No. 3,792,709 issued Feb. 19, 1974, entitled Fluid Flow Director of which the inventor is the inventor of the present invention. The device of U.S. Pat. No. 3,792,709 employs a rather complicated exit valve, the base of which is seated in a specially configured expanded portion of a hollow tubular member adjacent the devices outlet. The valve is immobile and permits by-pass of water around it when the tubular member is sufficiently expanded under water pressure. This device operates successfully except when encountering of the most stubborn types of pipe clogs.

There still is a need for a less expensive, simpler pipe flushing device which can safely and without pipe damage unclog pipes having even those stubborn clogs which heretofore have required drastic unclogging procedures such as Roto-Rooter type devices. Such device should be durable and easy to use by an unskilled person.

SUMMARY OF THE INVENTION

The improved pipe flushing device of the present invention satisfies all the foregoing needs. The device is substantially as set forth in the Abstract above. Thus, the device comprises an elongated, preferably generally, cylindrical, elastomeric hollow tubular member bearing a hose connector at its inlet end and a valve at its outlet end. The valve is in the form of a cage having a transverse rear closure plate disposed in a tranverse groove in the outlet. The groove is of a length greater than the thickness of plate, but grips the plate to hold the cage in a fixed position when the tubular member is in the unexpanded state. The cage has open sides and front.

Water is passed into the device while it is installed in a water pipe to be flushed, causing the middle portion of the tubular member to expand to the pipe diameter and causing the cage to pass rearwardly in the groove, in turn causing sonic vibration in the tubular member and pipe. The expansion permits the water to by-pass the plate and pass out the outlet through the cage sides and front as a jet. This results in contraction of the middle portion of the tubular member, forcing the cage forward, causing a vibration and closing the valve. The process then repeats rapidly so that water jet pulses and mechanical vibrations emanate rapidly from the device to easily dislodge the most stubborn pipe clogs. The jet expulsion also sets up strong mechanical vibrations in the device and pipe.

Various other features of the improved water pipe flushing device of the present invention are set forth in the following detailed description and accompanying drawings.

DETAILED DESCRIPTION OF THE PREFERRED EMBODIMENTS

FIGS. 1–4

Figure 1:
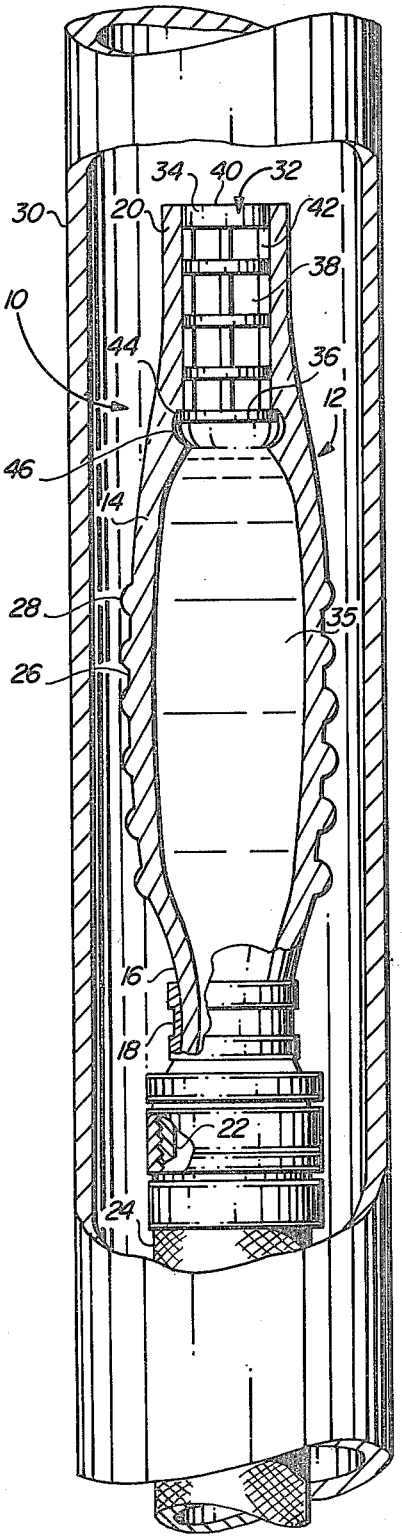
FIG. 1 is a schematic side elevation, partly in section, showing a first preferred embodiment of the improved pipe flushing device of the present invention in the relaxed or unexpanded state in a pipe to be unclogged.
Figure 2:
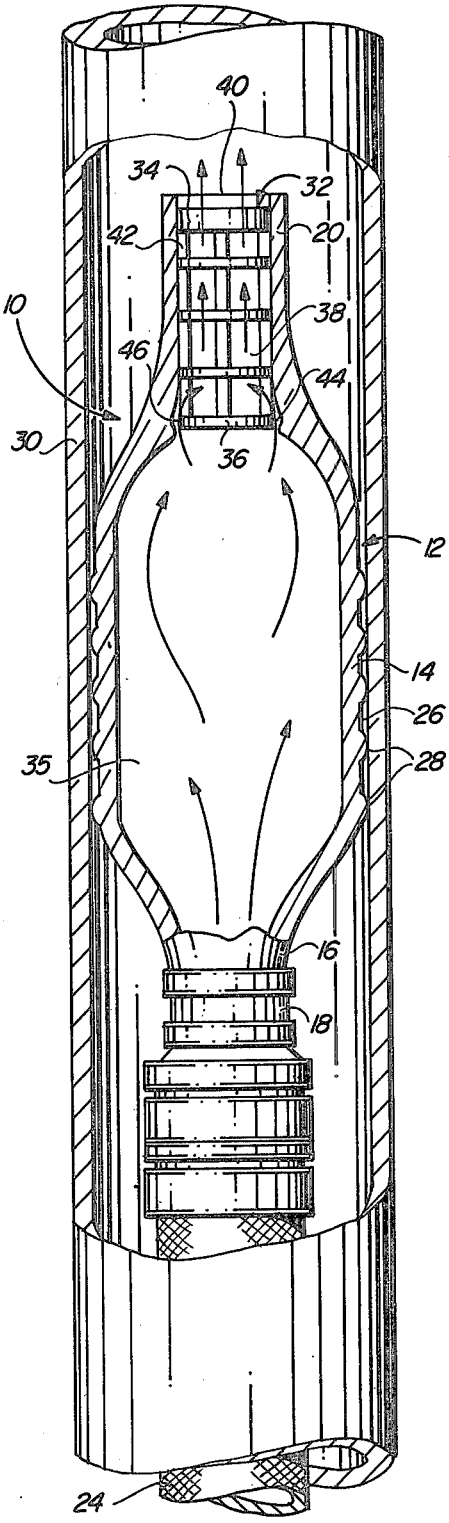
FIG. 2 is a schematic side elevation, partly in section, showing the device of FIG. 1 shown in the expanded state, due to water pressure or the like fluid pressure but with the water or other fluid by-passing the valve of the device to provide a jet.
Figure 3:
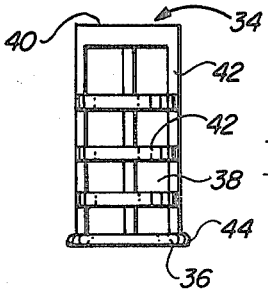
FIG. 3 is a schematic side elevation of the valve cage of the device of FIG. 1.

Now referring more particularly to FIGS. 1–4, a first preferred embodiment of the improved pipe flushing device of the present invention is schematically depicted therein. Thus, device 10 is shown which comprises an elongated, generally cylindrical, hollow, open ended tubular member 12, having a readily radially expandable middle portion 14, an inlet 16 secured to a conventional metallic, ceramic or plastic water hose connector 18, and a water jet outlet 20. Connector 18 is shown in FIGS. 1 and 2 releasably connected to the connected portion 22 of a water hose 24.

It will be noted that inlet 16 and outlet 20 are of smaller diameter than portion 14 in the unexpanded state shown in FIG. 1. Narrowing the diameter of outlet 20 facilitates its insertion in a pipe or other conduit. Member 12 is integral and formed of flexible, resilient, elastic elastomeric material such as natural rubber, synthetic rubber, rubber-like plastic or other flexible, resilient and elastic material. Certain plastisols and organosols can, for example, be used if desired.

The external surface 26 of portion 14 bears a plurality of spaced, transverse integral elastic ribs 28 which facilitate sliding of device 10 in pipe 30 when device 10 is in the pipe-engaging expanded state shown in FIG. 2 and which strengthen portion 14 without materially increasing its weight. If desired, the mid-portion of portion 14 can be of a reduced thickness to facilitate ready expansion thereof. As can be seen in FIGS. 1 and 2, portion 14 of device 10 can readily expand radially under water pressure from the unexpanded relaxed state of FIG. 1 to the fully expanded pipe-filling state of FIG. 2.

Device 10 also includes a valve 32 of plastic, metal, hardened rubber, etc. and comprising a cage 34 secured in outlet 20. Cage 34 is elongated, hollow and preferably cylindrical, with a rear closure plate 36 and open sides 38 and front 40 defined by spaced ribs 42. Plate 36 is transverse of member 12 and its rim 44 extends peripheral of sides 38 and lines in a transverse groove 46, in outlet 20, the length of which groove 46 is greater than the thickness of rim 44.

When member 12 is in the relaxed state shown in FIG. 1, outlet 20 grips cage 34 tightly, holding it in place at the front end of groove 46. As member 12 expands to the fully expanded state shown in FIG. 2 in response to water under pressure introduced thereinto cage 34 is initially pushed forward 1/16 inch by the water pressure. However, the shape and slope of groove 46 are such that cage 34 moves rearwardly, about 1/16 inch at the instant valve 32 opens, as hereafter more particularly described, with rim 44 reaching the rear end of groove 46. Cage 34 is still trapped by rim 44 in groove 46 but is unseated when valve 32 is open. Rapid movement of cage 34 between the positions of FIG. 1 and FIG. 2 causes rim 44 to strike outlet 20, suddenly and thereby causes some mechanical vibrations to be set up in member 12 and be transmitted to pipe 30, aiding in dislodging clogs from pipe 30. Thus, movement of cage 34 during operation of device 10 occurs.

Figure 4:
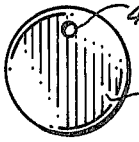
FIG. 4 is a schematic rear elevation of the valve cage of FIG. 3, showing the drain hole therein.
Figure 4A:
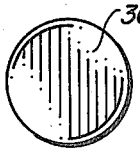
FIG. 4*a* is a schematic rear elevation of the valve cage of FIG. 3 without a drain hole.

Plate 36 also can contain a very small drain hole 48 (FIG. 4) so that water trapped in device 10 while valve 32 is closed can slowly drain away. In an alternate embodiment, a drain hole is not included in plate 36 (see FIG. 4*a*). Although drainage cannot then occur, this embodiment prevents dislodging of the device 10 is certain circumstances. For example, if a particuarly strong obstacle is encountered, the device 10 will expand and if the obstacle is not cleared, the drain hole 48 will allow water to pass through the drain hole 48, out of device 10 and enable a pressure build-up down stream of device 10 which tends to present a backward pressure tending to dislodge device 10 from the pipe 30. Use of a plate 36 without a drain hole 48 therein would prevent this from happening.

Valve 32 is normally closed, but opens only when water is introduced through hose 24 into the hollow interior 35 of member 12, to cause member 12 to expand sufficiently under the water pressure from hose 24 to permit water to by-pass plate 36, as shown in FIG. 2, specifically, traveling around rim 44 and then passing through sides 38 into cage 34 and out of open front 40. This occurs when cage 34 is unseated because portion 14 pulls the rear end of outlet 20 radially outwardly during radical expansion of portion 14. The size and position of rim 44, the angle and flexibility of the portion of outlet 20 defining groove 46, the water pressure and other factors cause this by-pass to occur. Water then issues from front 40 of cage 34 as a jet to help break up clogs in front of such jet. Expulsion of the jet vibrates the tubular member and pipe sonically.

The jet of water momentarily relieves the expansion of portion 14, causing portion 14 to contract so that cage 34 is moved forward, in turning causing a vibration and closing outet 30. Whereupon portion 14 immediately expands again to open outlet 20, emit a jet of water and vibrate member 12 and pipe 30. A vibration is also caused in pipe 30 when ribs 28 suddenly strike pipe 30 during expansion. This sequence occurs very rapidly and continuously until the water pressure is removed, the jets and mechanical vibrations effecting the desired unclogging and flushing of pipe 30 safety, rapidly and repeatedly. Thus, device 10 is simple to make and use, inexpensive and effective.

Figure 5:
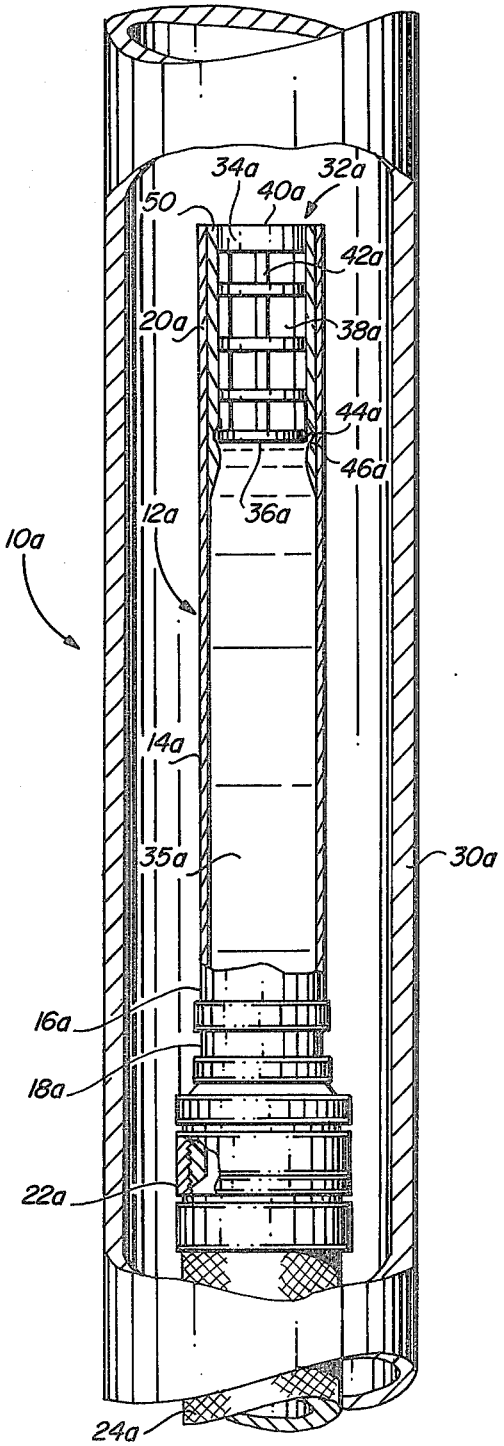
FIG. 5 is a schematic side elevation, partly in section, showing a second preferred embodiment of the improved pipe flushing device of the present invention installed in a pipe but in the relaxed or unexpanded state.
Figure 6:
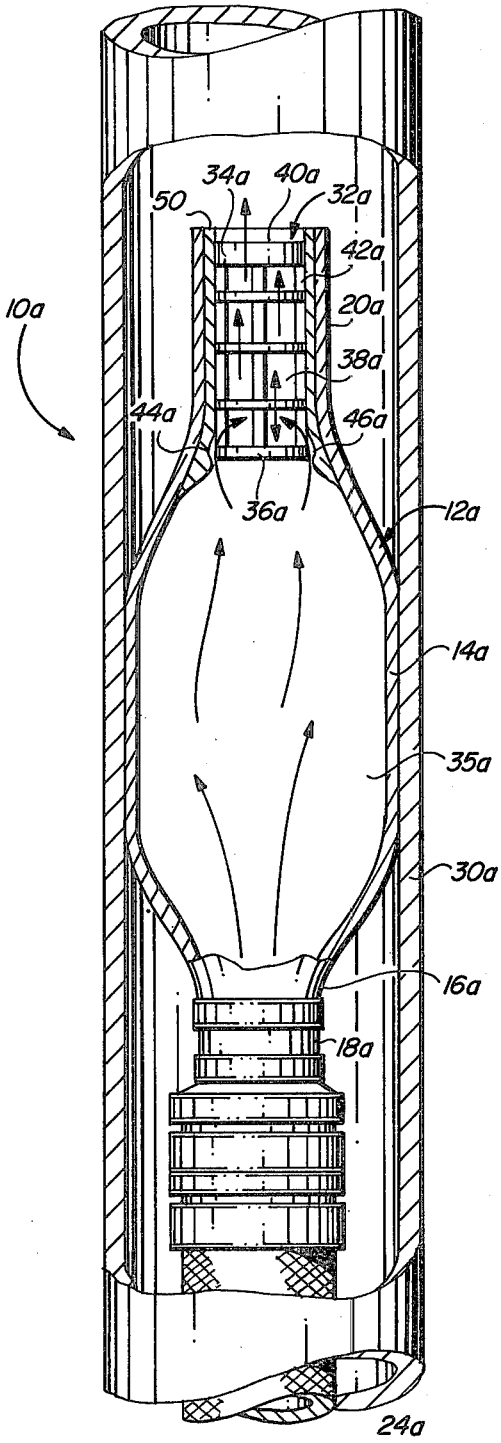
FIG. 6 is a schematic side elevation, partly in section, of the device of FIG. 5 shown in the expanded state, due to water pressure, or the like but with water or the like by-passing the valve of the device to provide a jet.

FIGS. 5 and 6

A second preferred embodiment of the improved pipe flushing device of the present invention is schematically depicted in FIGS. 5 and 6. Thus, device 10*a* is shown. All components similar to those of device 10 bear the same numerals but are succeeded by the letter "a".

Device 10*a* comprises hollow, cylindrical member 12*a* having open opposite ends 16*a* and 20*a* and a readily expandible middle portion 14*a*. Member 12*a*is of uniform outer diameter throughout. Inlet 16*a* is connected to a hose connector 18*a* shown releasably connected by connector 22*a* to water hose 24*a*.

Member 12*a* is of flexible, resilient, elastic material such as that used for member 12, and does not contain any external ribs. Outlet 20*a* is provided with a cylindrical, hollow, open ended, resilient, flexible insert 50 of material similar to member 12*a*. Insert 50 is glued, heat sealed or otherwise fixed in place in outlet 20*a* and bears groove 46*a* in which plate 36*a* of cage 34*a* is seated. Device 10*a* is shown in pipe 30*a* and functions similarly to device 10 to unclog and flush pipe 30. Thus, water entering the hollow interior 35*a* of member 12*a* under pressure expands portion 14*a* to cause it to contact the walls of pipe 30*a* and pull the rear end of outlet 20*a* outwardly radially sufficiently to cause unseating and rearward movement of cage 34*a* and by-passing of water around plate 36*a*. Thus, a jet of water is emitted from outlet 20*a* during each expansion stage in the rapidly repeated expansion contraction cycles exhibited by device 10*a*, causing strong mechanical vibrations. Vibrations are also due to the movement of valve 32*a* as previously described for device 10. Accordingly, device 10 has substantially all the advantages of device 10.

It will be understood that device 10 and 10*a* are also effective on conduits other than pipe and with fluids other than water. Various other modifications, changes, alterations and additions can be made in the improved pipe flushing device of the present invention, its components and their parameters. All such modifications, changes, alterations and additions as are within the scope of the appended claims from part of the present invention.

What is claimed is:

1. An improved pipe flushing device, said device comprising, in combination:

(a) an elongated elastomeric hollow tubular member having a generally central passageway extending through the length thereof, a middle portion which is radially expansible under water pressure, an open rear inlet end and an open front outlet end;

(b) a hose connector connected in sealing engagement with said rear inlet end; and (c) a valve in said front outlet end, said valve comprising a cage having a rear closure plate disposed across said outlet end and secured in a transverse groove in said tubular member outlet end, said groove being of a length longer than the thickness of said plate, said valve having open sides and front, said outlet end holding said valve in a fixed position to close said outlet when said tubular member is in the relaxed state and permitting longitudinal movement of said valve cage, while retaining said plate in said groove, upon expansion under water pressure of said tubular member, said expansion also permitting water to by-pass said closure plate through said groove and pass through said cage sides and front as a water jet, pulsations of said jet setting up mechanical vibrations, said jets and pulsations being effected by alternate expansion and contraction of said tubular member under water pressure to unclog a pipe.

2. the improved flushing device of claim 1 wherein the diameter of said outlet end is not in excess of that of said middle portion in the relaxed state.

3. The improved flushing device of claim 2 wherein the diameter of said outlet end is less than that of said middle portion in the relaxed state to facilitate insertion of said device into a drain pipe.

4. The improved flushing device of claim 2 wherein the outer diameter of said tubular member in the relaxed state is uniform throughout.

5. The improved flushing device of claim 4 wherein said outlet end has a tubular elastomeric insert secured thereto peripheral of said cage and bearing said groove in which said plate is seated and in which said plate rides during expansion of said middle portion.

6. The improved flushing device of claim 1 wherein said valve plate has a small drain orifice extending therethrough, longitudinally of said device and wherein movement of said cage causes mechanical vibrations in said tubular member.

7. The improved flushing device of claim 1 wherein said cage is elongated and cylindrical.

8. The improved flushing device of claim 7 wherein said cage comprises plastic.

9. The improved flushing device of claim 1 wherein said middle portion has external, integral, transverse, elastomeric reinforcing ribs which are adopted to contact and slide on the walls of a water pipe, minimizing frictional contact therewith and effecting vibration of a water pipe when suddenly contacting the same during expansion of said tubular member.

10. The improved flushing device of claim 1 wherein said tubular member has a mid-portion of reduced thickness.

11. The improved flushing device of claim 1 wherein said rear closure plate has an opening therein.

* * * * *